US005774953A

United States Patent [19]

Mao

[11] Patent Number: 5,774,953

[45] Date of Patent: Jul. 7, 1998

[54] BUCKLING DEVICE FOR BAGGAGE AND THE LIKE

[76] Inventor: Chen Shou Mao, 344 Section I, Chung Shan Rd. Tah-Cha Township, Taichung Hsien, Taiwan

[21] Appl. No.: 848,900

[22] Filed: May 1, 1997

[51] Int. Cl.[6] ..... A44B 11/25

[52] U.S. Cl. ..... 24/585; 24/191; 24/170

[58] Field of Search ..... 24/585, 584, 580, 24/572, 323, 308, 191, 170, 68 R, 68 A, 68 SK, 68 E, 68 T, 633, 636

[56] References Cited

U.S. PATENT DOCUMENTS

| | | | |
|---|---|---|---|
| 3,267,545 | 8/1966 | Eckart | 24/585 |
| 4,727,630 | 3/1988 | Alan | 24/585 |
| 4,733,440 | 3/1988 | Ogawa | 24/585 X |
| 4,903,381 | 2/1990 | Föhl | 24/585 |
| 4,999,846 | 3/1991 | Ball et al. | 24/191 X |
| 5,184,352 | 2/1993 | Maufette | 24/585 |
| 5,267,679 | 12/1993 | Kamaya et al. | 24/585 X |
| 5,572,771 | 11/1996 | Kelleghan | 24/191 X |
| 5,579,563 | 12/1996 | Sim | 24/170 X |
| 5,588,186 | 12/1996 | Ko | 24/585 |

FOREIGN PATENT DOCUMENTS

| | | | |
|---|---|---|---|
| 6-237805 | 8/1994 | Japan | 24/585 |

*Primary Examiner*—James R. Brittain
*Assistant Examiner*—Robert J. Sandy
*Attorney, Agent, or Firm*—Harrison & Egbert

[57] ABSTRACT

A buckling device includes a fastening strap and a catch. The fastening strap is slidably mounted on a strap seat which is fastened with a movable part of an article. The fastening strap is provided with a toothed portion extending along the longitudinal direction of the fastening strap. The catch includes a retaining member and a pivoting seat to which the retaining member is fastened pivotally by a pivoting shaft in conjunction with a spring. The retaining member is provided with a pawl engagedble and engageable with the toothed portion of the fastening strap. The pivoting seat is fastened with another part of the article such that the pivoting seat is corresponding in location to the strap seat.

5 Claims, 8 Drawing Sheets

BUCKLING DEVICE FOR BAGGAGE AND THE LIKE

FIELD OF THE INVENTION

The present invention relates generally to a bucckling device, and more particularly to the buckling device intended for use in the baggages and the like.

BACKGROUND OF THE INVENTION

As shown in FIGS. 1 and 2, a buckling device of the prior art consists of a fastening strap 11 and a catch 15. The fastening strap 11 is provided with a plurality of retaining teeth 12. The fastening strap 11 is provided at one end thereof with a fastening hole 13 for fastening the strap 11 with an article by means of a rivet 14. The catch 15 is provided with a guide 16, an elastic plate 17, a plurality of retaining projections 18, a wedge-shaped edge 19, a tension rod 20, and a wedge-shaped body 21 urging the wedge-shaped edge 19 to enable the elastic plate 17 to actuate the retaining projections 18 to become disengaged with the retaining teeth 12 of the fastening strap 11.

The prior art buckling device described above is defective in design in that both fastening strap 11 and the catch 15 are fixed with precision at the opposite positions of two things or parts which are intended to be held together, and that the disengagement of the fastening strap 11 with the catch 15 can not be done with one hand, and further that the catch 15 is rather complicated in construction.

SUMMARY OF THE INVENTION

The primary objective of the present invention is to provide a buckling device which is free from the drawbacks of the prior art buckling device described above.

In keeping with the principle of the present invenion, the foregoing objective of the present invention is attained by a buckling device, which consists of a fastening strap, a strap seat, and a catch. The fastening strap is provided with a toothed surface and is slidably mounted in the strap seat which is fastened securely with an article to be held together with another article. The catch comprises a retaining member and a pivoting seat which is fastened securely with another object such that the pivoting seat is corresponding in location to the strap seat. The retaining member is provided with a retaining surface capable of catching and holding the toothed surface of the fastening strap. The retaining surface of the retaining member of the catch can be easily disengaged with the toothed surface of the fastening strap by lifting the lift plate of the retaining member.

The foregoing objective, features and functions of the present invention will be more readily understood upon a thoughtful deliberation of the following detailed description of the embodiments of the present invention with reference to the accompanying drawings.

DETAILED DESCRIPTION OF THE EMBODIMENTS

Figure 1:
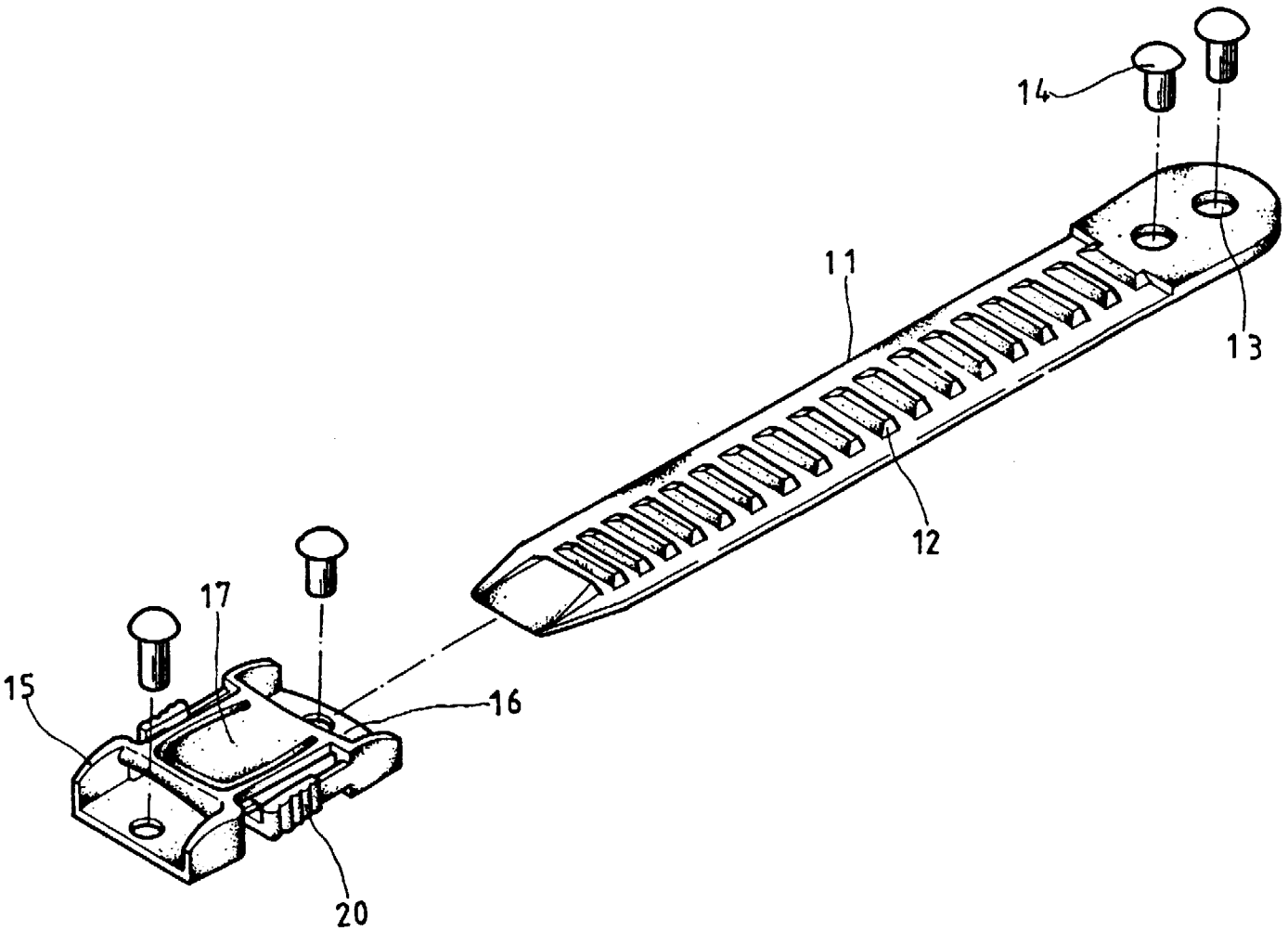
FIG.1 PRIOR ART
FIG. 1 shows an exploded view of a buckling device of the prior art.
Figure 2:
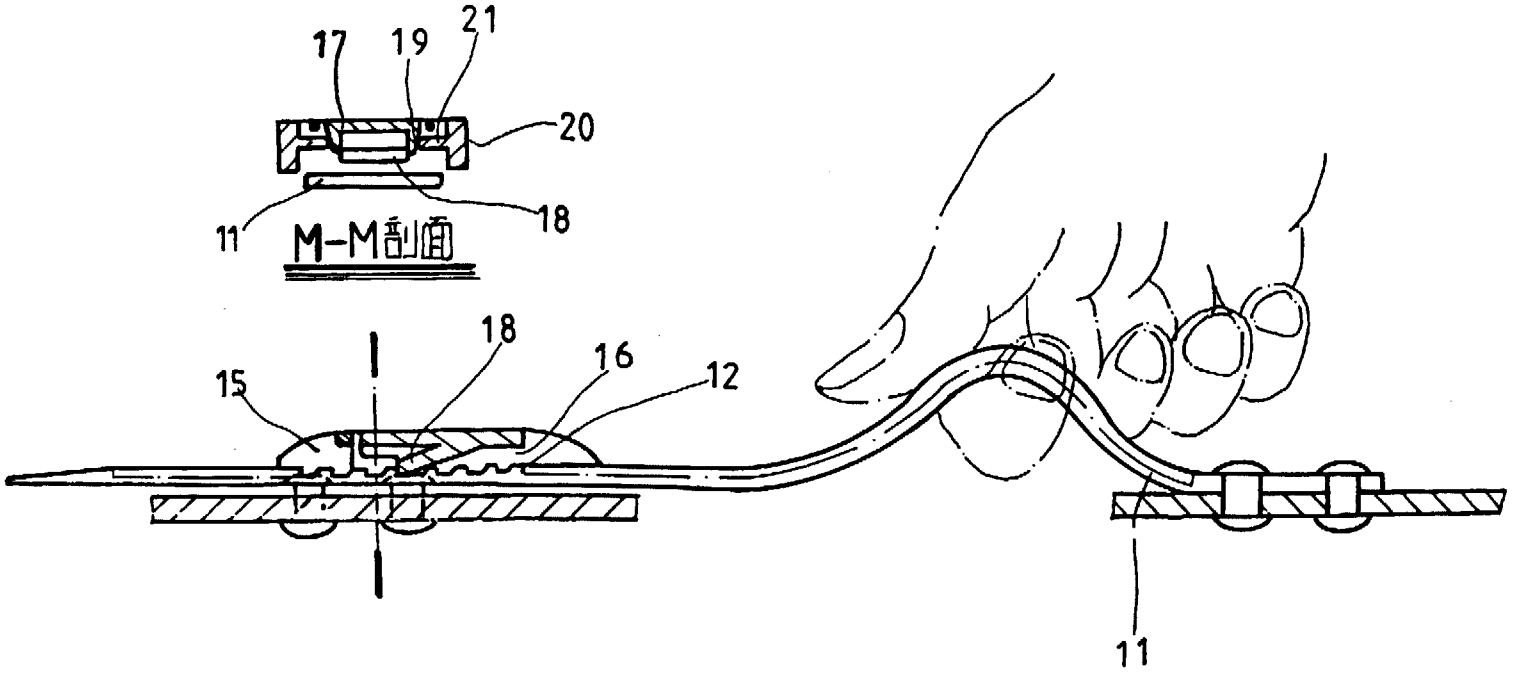
FIG.2 PRIOR ART
FIG. 2 shows a sectional view of the prior art buckling device in combination.
Figure 3:
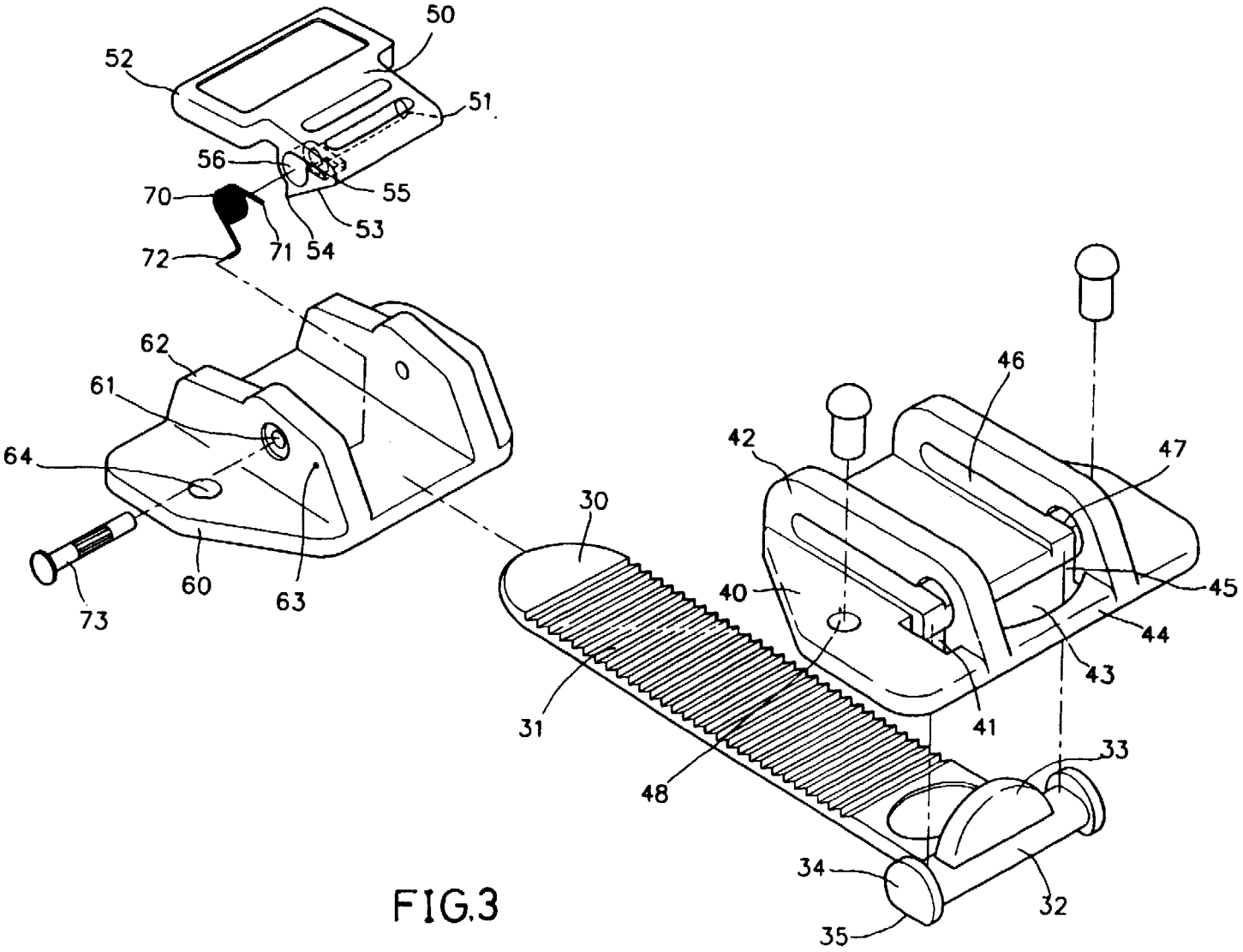
FIG. 3 shows an exploded view of a first preferred embodiment of the present invention.
Figure 4:
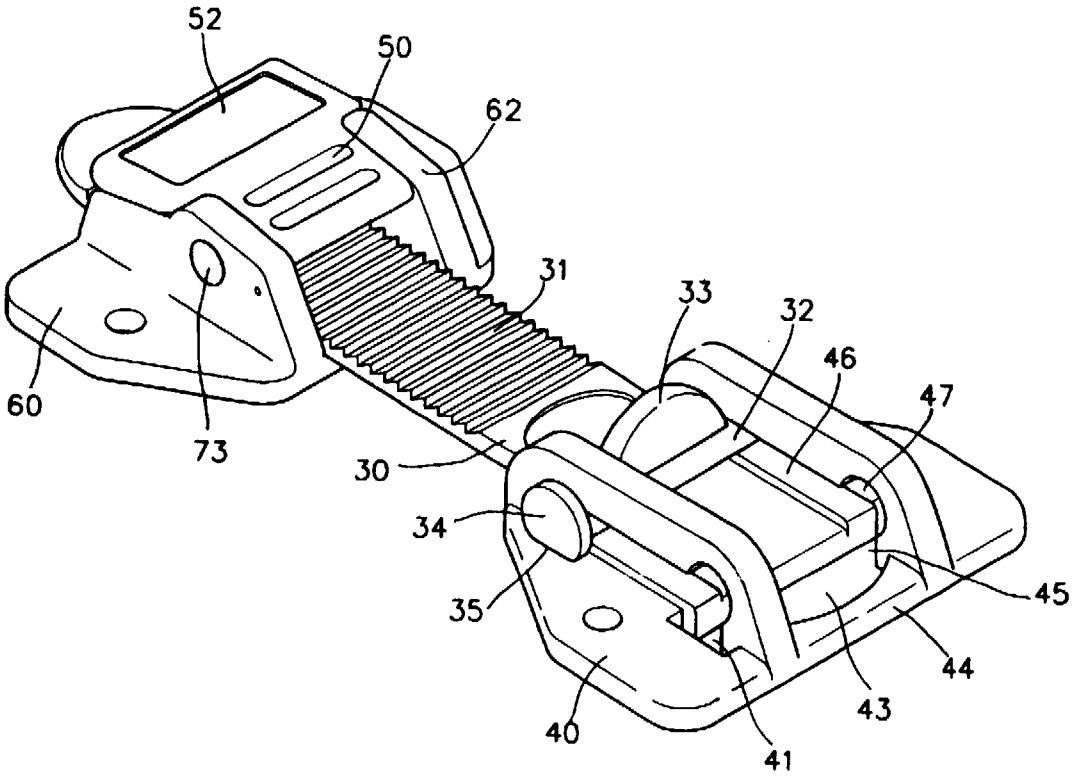
FIG. 4 shows a perspective view of the first preferred embodiment in combination according to the present invention.

As shown in FIGS. 3–6, a buckling device of the first preferred embodiment of the present invention is composed of a fastening strap 30, a strap seat 40, and a catch consisting of a retaining member 50, a pivoting seat 60, a spring 70, and a shaft 73.

The fastening strap 30 is provided in the upper surface thereof with a toothed portion 31 of a predetermined length and extending in the longitudinal direction of the fastening strap 30. The fastening strap 30 is further provided at one end thereof with a rod 32 having an arcuated projection 33 extending upwards from the midsegment of the rod 32. The rod 32 has two end plates 34 provided respectively with a flat bottom 35.

The strap seat 40 is provided on the upper surface thereof with a through slot 41 extending along the direction of the longitudinal axis of the strap seat 40. The strap seat 40 is further provided with two parallel ribs 42 traversing the through slot 41. The ribs 42 is provided with a guide slot 45 and an insertion slot 46. The through slot 41 is provided with a mouth 43 and a support rod 44. The strap seat 40 is further provided with a swiveling portion 47 and two fastening holes 48 engageable with two fastening screws for fastening the strap seat 40 with an article or a part of the article.

The retaining member 50 is provided with a pivoting hole 51, a lift plate 52, and a slanted guide edge 53. The pivoting hole 51 is provided with a fitting hole 56 which is in turn provided with a front braking slot 55. The slanted guide edge 53 is provided with a reverse tooth 54 similar in construction and function to a pawl.

The pivoting seat 60 is provided with two lugs 62 parallel to each other and having an axial hole 61 and an insertion hole 63. The pivoting seat 60 is further provided with two fastening holes 64 engageable with two fastening screws for fastening the pivoting seat 60 with another article or another part of the article to which the strap seat 40 is fastened.

The spring 70 is received in the fitting hole 56 such that a straight end 71 of the spring 70 is located in the front braking slot 55, and that a curved end 72 of the spring 70 is located in the insertion hole 63.

The shaft 73 is received in the pivoting hole 51 of the retaining member 50 such that the shaft 73 is fitted into the spring 70, and that the shaft 73 is received in the axial holes 61 of the pivoting seat 60.

Figure 5:
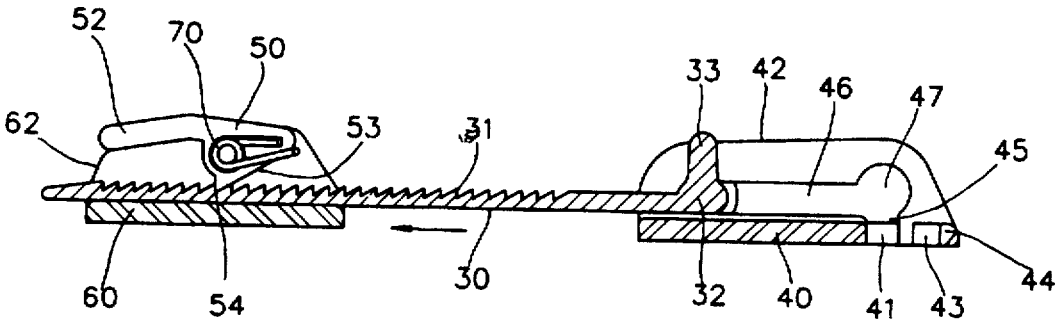
FIG. 5 shows a longitudinal sectional view of the first preferred embodiment in combination according to the present invention.

In combination, the front end of the fastening strap 30 is put through the mouth 43 located between the two ribs 42 before the rod 32 of the fastening strap 30 is put through the through slot 41 and the guide slot 45 such that the end plates 34 of the rod 32 rest against the outer sides of the ribs 42 of the strap seat 40, and that the arcuate projection 33 of the rod 32 is lifted to allow the rod 32 to enter the swiveling portion 47 of the strap seat 40. As a result, the strap 30 is slidably mounted on the strap seat 40 such that the strap 30 can be moved back and forth on the strap seat 40 by manipulating the arcuate projection 33 of the rod 32 with fingers. The retaining member 50 of the catch is pivotally fastened with the pivoting seat 60 which is fastened with another article or another part of the article to which the strap seat 40 is fastened. The strap seat 40 is corresponding in location to the pivoting seat 60. The buckling effect is brought about easily by holding and pushing the arcuate projection 33 so as to cause the front end of the fastening strap 30 to locate under the slanted guide edge 53 of the retaining member 50 and between the two lugs 62 of the pivoting seat 60, thereby enabling the toothed portion 31 of the fastening strap 30 to be caught by the reverse tooth 54 of the retaining member 50, as illustrated in FIG. 5.

Figure 6:
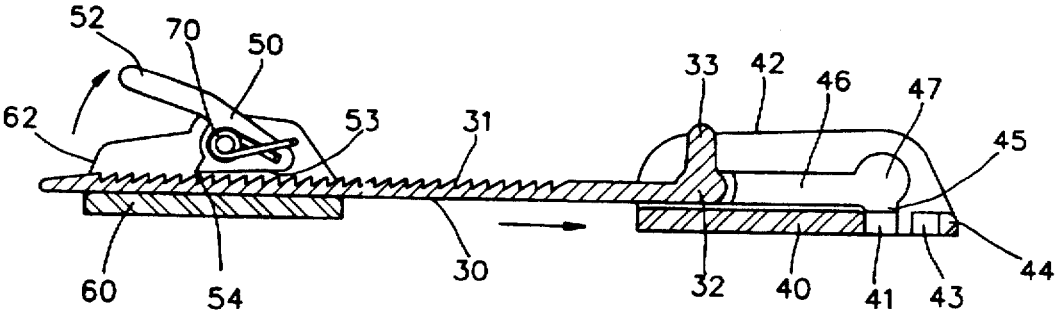
FIG. 6 shows a schematic view of the first preferred embodiment at work according to the present invention.

The fastening strap 30 can be disengaged with the retaining member 50 of the catch by lifting the lift plate 52 of the retaining member 50 such that the reverse tooth 54 (pawl) is raised to free the fastening strap 30, as illustrated in FIG. 6.

Figure 7:
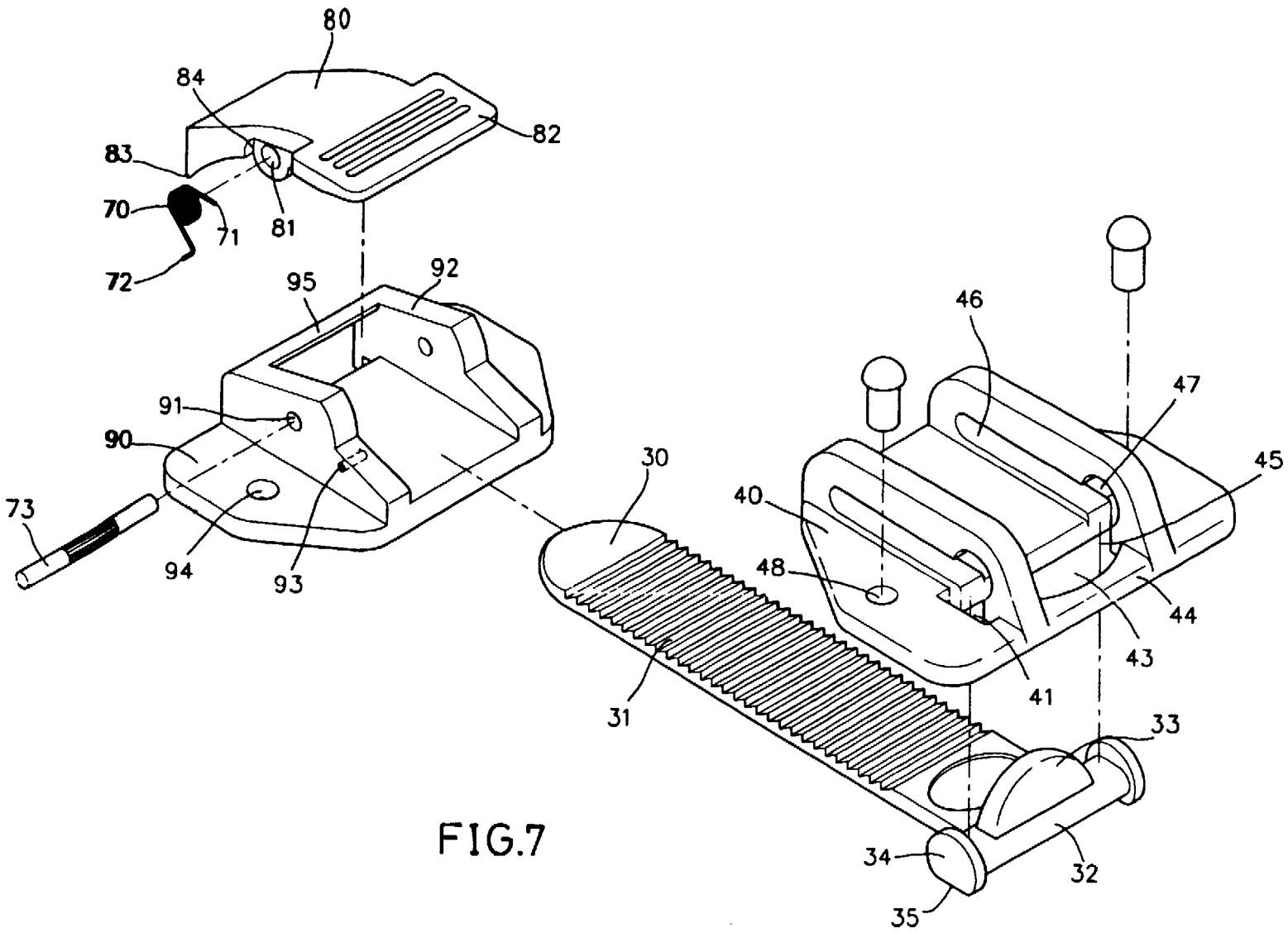
FIG. 7 shows an exploded view of a second preferred embodiment of the present invention.
Figure 8:
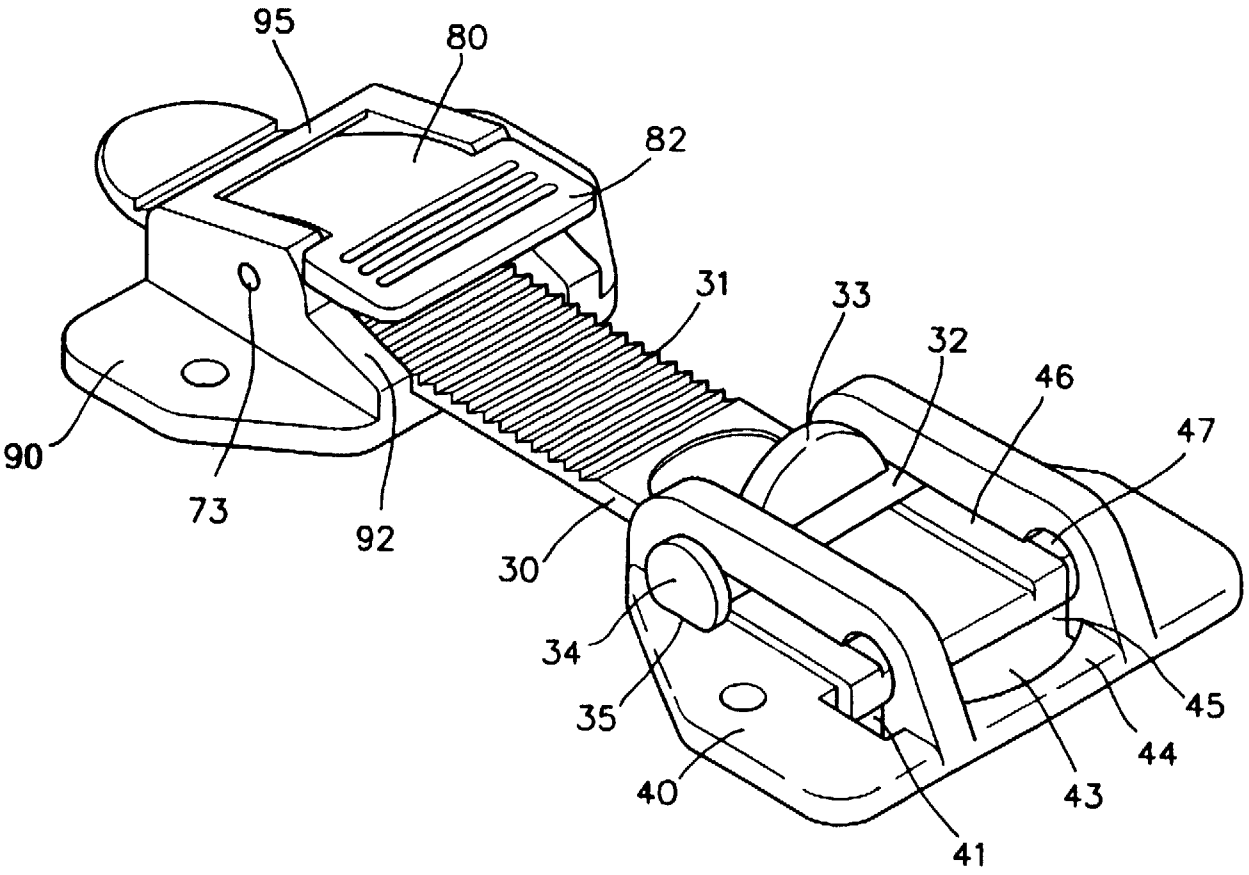
FIG. 8 shows a perspective view of the second preferred embodiment in combination according to the present invention.

As shown in FIGS. 7 and 8, the catch of the present invention may be modified to consist of a retaining apparatus 80, a pivoting seat 90, a spring 70, and a shaft 73.

The retaining apparatus 80 is provided with a pivoting hole 81, a press board 82, and a reverse tooth 83 similar in construction and function to a pawl. The pivoting hole 81 is provided at the end thereof with a fitting edge 84.

The pivoting seat 90 is provided with two parallel lugs 92, which are in turn provided with an axial hole 91 and an insertion hole 93. The insertion hole 93 may be replaced by an insertion edge. The lugs 92 are braced by a bracing rod 95. The pivoting seat 90 is provided with two fastening holes 94 engageable with two fastening screws (not shown in the drawings) for fastening the pivoting seat 90 with an article or a part of the article.

The spring 70 is located at the fitting edge 84 of the pivoting hole 81 such that a straight end 71 of the spring 70 urges the top of the fitting edge 84, and that a curved end 72 of the spring 70 is located in the insertion hole 93 of the pivoting seat 90.

The shaft 73 is received in the pivoting hole 81 of the retaining apparatus 80 and the axial holes 91 of the pivoting seat 90 such that the shaft 73 is fitted into the spring 70.

Figure 9:
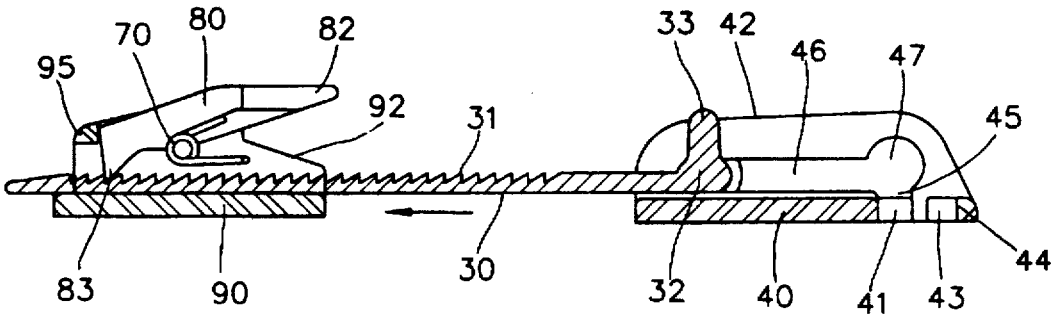
FIG. 9 shows a longitudinal sectional view of the second preferred embodiment in compination according to the present invention.

As illustrated in FIG. 9, the buckling effect of the second preferred embodiment of the present invention is brought about by holding and pushing the arcuate projection 33 of the fastening strap 30 with finger such that the front end of the fastening strap 30 is located under the press board 82 of the retaining apparatus 80 and between the two lugs 92 of the pivoting seat 90, thereby enabling the toothed portion 31 of the fastening strap 30 to be caught by the reverse tooth 83 (pawl) of the retaining apparatus 80.

Figure 10:
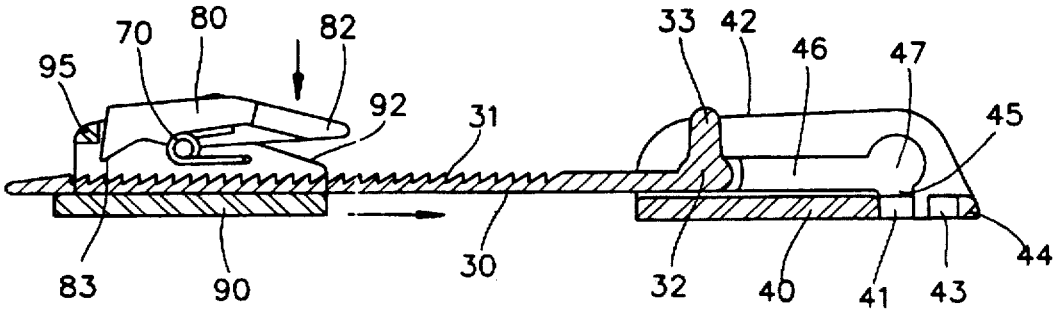
FIG. 10 shows a schematic view of the second preferred embodiment at work according to the present invention.

In the process of freeing the fastening strap 30 which is caught securely by the retaining apparatus 80, the press board 82 of the retaining apparatus is first pressed with finger to cause the pawl 83 to rise to disengage the tooth of the toothed portion 31 of the fastening strap 30. Thereafter, the fastening strap 30 is withdrawn by holding and sliding the arcuate projection 33 of the rod 32 of the fastening strap 30 in the direction away from the retaining apparatus 80 of the catch, as illustrated in FIG. 10.

The embodiments of the present invention described above are to be deemed in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A buckling device comprising:

a fastening strap of a predetermined length and provided with a toothed portion extending along the direction of a longitudinal axis of said fastening strap, said fastening strap further provided at one end of the longitudinal axis thereof with a projection to facilitate the holding of said fastening strap with fingers, said Projection of said fastening strap being located on a rod provided respectively at both ends with an end plate having a flat bottom;

a strap seat provided with a plurality of fastening holes engageable with fastening screws for fastening said strap seat with a part of an article, said strap seat provided with two parallel ribs and a through slot located between said two parallel ribs for accommodating said toothed portion of said fastening strap such that said fastening strap can be slid back and forth in said through slot, said strap seat being provided with a guide slot to accommodate said rod of said fastening strap such that said end plates of said rod press against said ribs of said strap seat; and a means for catching said fastening strap such that two parts of the article are held together.

2. A buckling device comprising:

a fastening strap of a predetermined length and provided with a toothed portion extending along the direction of a longitudinal axis of said fastening strap, said fastening strap further provided at one end of the longitudinal axis thereof with a projection to facilitate the holding of said fastening strap with fingers;

a strap seat provided with a plurality of fastening holes engageable with fastening screws for fastening said strap seat with a part of an article, said strap seat provided with two parallel ribs and a through slot located between said two is that correct should that be in ribs for accommodating said toothed portion of said fastening strap such that said fastening strap can be slid back and forth in said through slot; and means for catching said fastening strap such that two parts of an article are held together, said means for catching comprises:

a retaining member having a pivoting hole, a lift plate, and a slanted guide edge, said pivoting hole provided with a fitting hole which is provided with a braking slot, said slanted guide edge provided with a pawl;

a pivoting seat provided with a plurality of fastening holes engageable with fastening screws for fastening said pivoting seat with another part of the article such that said pivoting seat is corresponding in location to said strap seat, said pivoting seat provided with two parallel lugs each having an axial hole and an insertion hole;

a biasing means having a straight end and a curved end, said biasing means being received in said fitting hole of said retaining member such that said straight end is located in said braking slot of said fitting hole, and that said curved end of said biasing means is located in said insertion hole of said lugs; and a pivoting shaft for fastening pivotally said retaining member with said pivoting seat such that said pivoting shaft is received in said pivoting hole of said retaining member and said axial holes of said pivoting seat, and that said pivoting shaft is fitted into said biasing means.

3. A buckling device comprising:

a fastening strap of a predetermined length and provided with a toothed portion extending along the direction of a longitudinal axis of said fastening strap, said fastening strap further provided at one end of the longitudinal axis thereof with a projection to facilitate the holding of said fastening strap with fingers;

a strap seat provided with a plurality of fastening holes engageable with fastening screws for fastening said strap seat with a part of an article, said strap seat provided with two parallel ribs and a through slot located between said ribs for accommodating said toothed portion of said fastening strap such that said fastening strap can be slid back and forth in said through slot; and a means for catching said fastening strap such that two parts of an article are held together, said means for catching comprises:

a retaining apparatus provided with a pivoting hole, a press board, and a pawl, said pivoting hole provided at one end thereof with a fitting edge;

a pivoting seat provided with a plurality of fastening holes engageable with fastening screws for fastening said pivoting seat with another part of the article such that said pivoting seat is corresponding in location to said strap seat, said pivoting seat provided with two parallel lugs each having an axial hole and an insertion hole;

a biasing means having a straight end and a curved end, said biasing means being located at said fitting edge of said pivoting hole of said retaining apparatus such that said straight end urges a top of said fitting edge, and that said curved end is located in said insertion hole of said lugs of said pivoting seat; and a pivoting shaft for fastening pivotally said retaining apparatus with said pivoting seat such that said pivoting shaft is received in said pivoting hole of said retaining apparatus and said axial holes of said pivoting seat, and that said pivoting shaft is fitted into said biasing means.

4. The buckling device as defined in claim 2, wherein said pawl of said retaining member is engageable and disengageable with said toothed portion of said fastening strap.

5. The buckling device as defined in claim 3, wherein said pawl of said retaining apparatus is engageable and disengageable with said toothed portion of said fastening strap.

* * * * *